US009101848B1

(12) United States Patent
Henderson

(10) Patent No.: US 9,101,848 B1
(45) Date of Patent: Aug. 11, 2015

(54) WALL CRASHER

(71) Applicant: Ted Henderson, Faro (CA)

(72) Inventor: Ted Henderson, Faro (CA)

( * ) Notice: Subject to any disclaimer, the term of this patent is extended or adjusted under 35 U.S.C. 154(b) by 0 days.

(21) Appl. No.: 14/308,425

(22) Filed: Jun. 18, 2014

Related U.S. Application Data

(60) Provisional application No. 61/776,982, filed on Mar. 12, 2013.

(51) Int. Cl.

| | |
|---|---|
| ***A63G 31/00*** | (2006.01) |
| ***A47D 15/00*** | (2006.01) |
| ***A47C 31/00*** | (2006.01) |
| *A63H 15/06* | (2006.01) |

(52) U.S. Cl.
CPC ..... *A63H 15/06* (2013.01); *A47C 31/00* (2013.01); *A47D 15/001* (2013.01)

(58) Field of Classification Search
CPC ..... A63G 31/00; A63G 31/12; A63B 2225/62
USPC ..... 472/134, 136; 482/35–37
See application file for complete search history.

(56) References Cited

U.S. PATENT DOCUMENTS

| | | | | |
|---|---|---|---|---|
| 4,516,767 | A | 5/1985 | Eskijian | |
| 6,322,454 | B1 * | 11/2001 | Gordon | 472/134 |
| 6,533,626 | B2 * | 3/2003 | Pons | 441/80 |
| 6,551,215 | B1 * | 4/2003 | Gordon | 482/35 |
| 7,108,608 | B2 | 9/2006 | Field et al. | |
| 7,878,877 | B2 | 2/2011 | Scherba | |
| 8,021,237 | B2 * | 9/2011 | Akers | 472/44 |
| 2008/0035903 | A1 | 2/2008 | Newton | |
| 2009/0211168 | A1 | 8/2009 | Bogar | |

* cited by examiner

*Primary Examiner* — Kien Nguyen
(74) *Attorney, Agent, or Firm* — Luca D'Ottone; KB Patents

(57) ABSTRACT

The inventive device object of the present application is a vertically-standing mattress, which is designed to automatically reassume its vertical orientation when pushed down. Attached to either side of the mattress is a padded bar, preventing injury. The mattress is automatically wound into its initial orientation by a taut coil of elastic rope housed in a plastic container.

6 Claims, 7 Drawing Sheets

WALL CRASHER

CLAIM OF PRIORITY FROM RELATED APPLICATIONS

The present application claims priority from U.S. Provisional Patent Application No. 61/776,982 filed on Mar., 12$^{th}$ 2013 to Ted Henderson from Faro (YU), directed to a WALL CRASHER, that is hereby incorporated by reference.

BACKGROUND OF THE INVENTION

1. Field of the Invention

The inventive device disclosed in the present application generally relates to children's entertainment equipment and more specifically to a vertically-standing mattress designed to automatically reassume its vertical orientation when pushed down.

2. Brief Description of the Prior Art

Trampoline mattresses are well known in the art. Various Patents and Published Patent applications are in fact directed to vertically-standing trampoline mattresses. While developing the invention of the instant application independently the Inventor researched extensively the public record as well as the current market for calibrated baby feeding bottles and the most relevant examples found in the search are mentioned in the Information Disclosure Statement (IDS) attached.

Despite all the efforts listed above prior art patents describe structures that are either not truly convenient or else involve complicated, expensive, and overly difficult assembly and/or disassembly parts and procedures. Other devices have been advertised on various media but never patented or described into a printed publication.

SUMMARY OF THE INVENTION

The inventive device object of the present application is an ergonomically shaped vertically-standing mattress, which is designed to automatically reassume its vertical orientation when pushed down. Attached to either side of the mattress is a padded bar, preventing injury. The mattress is automatically wound into its initial orientation by a taut coil of elastic rope housed in a plastic container.

It is then the principal object of the present invention to provide a mattress capable of automatically readjusting to its initial position.

It is a secondary objective of the present invention to provide tool for children to safely exercise with.

It is an additional objective of the present invention to provide a device that does not rust or deteriorate over time and may be safely used to exercise. It is a final objective of the present invention to provide for a device that is relatively inexpensive to build, but that can eventually be sold at a premium.

These and other objective achieved by the device of the present invention will be apparent by the drawings, by their detailed description, and by the specification here from appended.

DESCRIPTION OF THE PREFERRED EMBODIMENT

Figure 1:
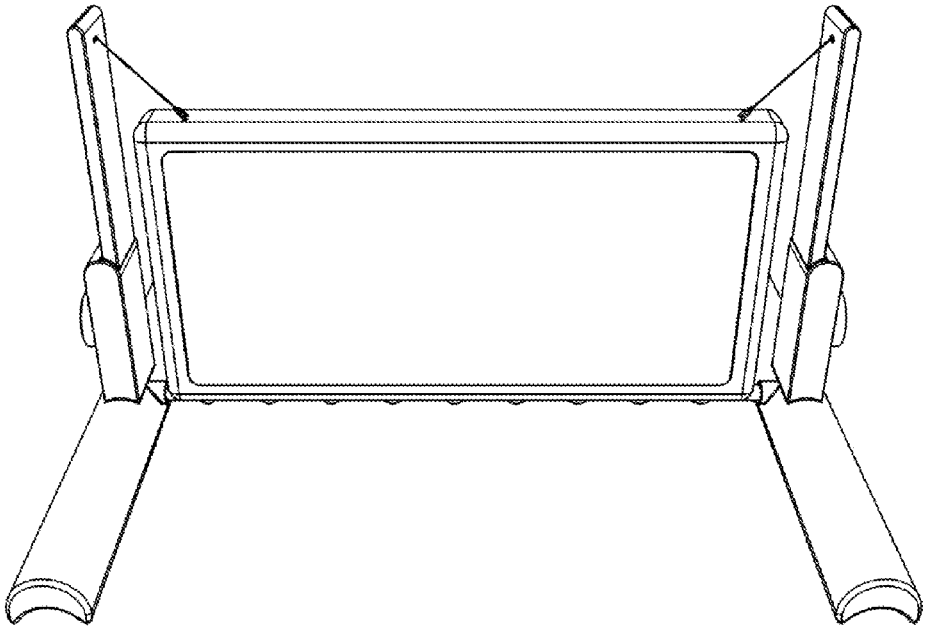
FIG. 1 is a front elevation view of one of the preferred embodiments of the "Wall Crasher" in accordance with the teachings of the present invention.
Figure 2:
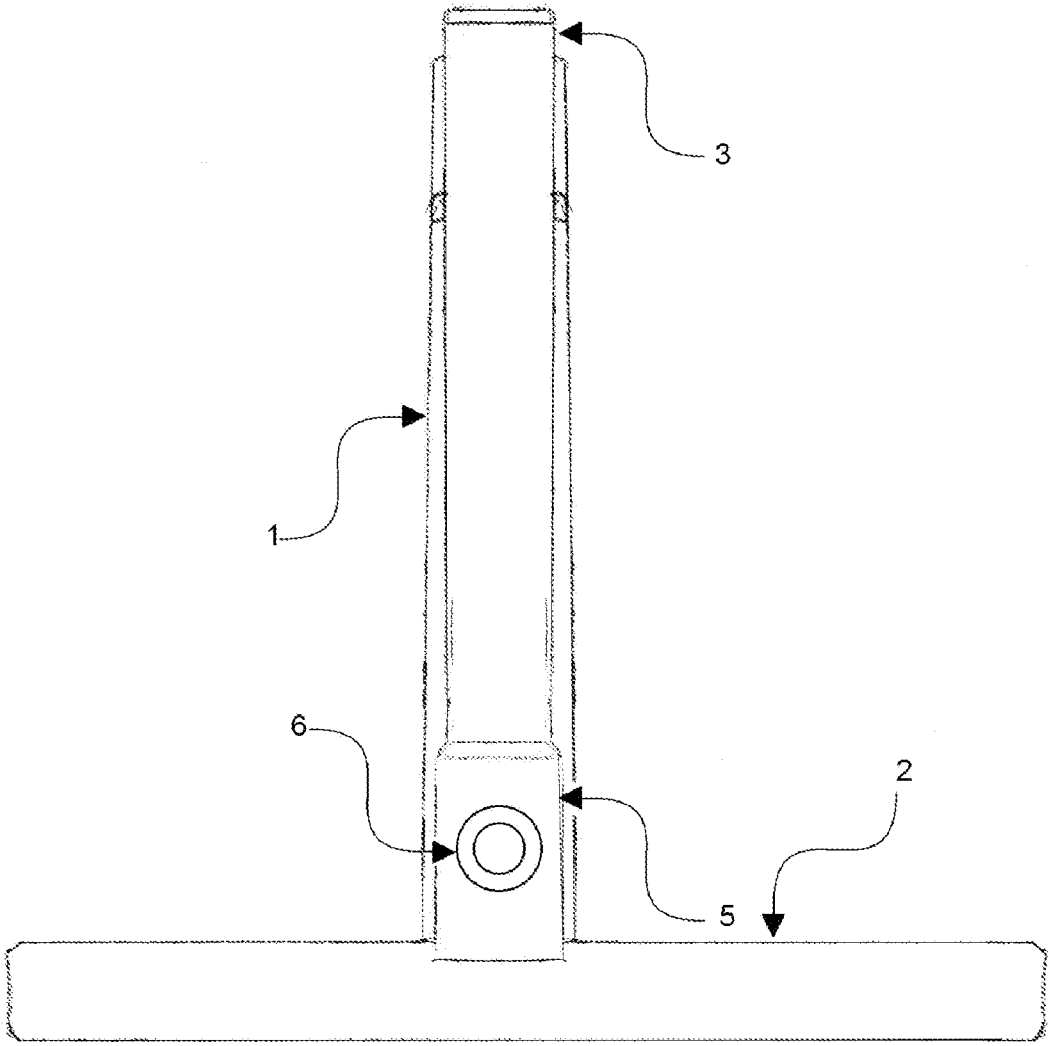
FIG. 2 is a left side elevation view of the "Wall Crasher" of FIG. 1.
Figure 3:
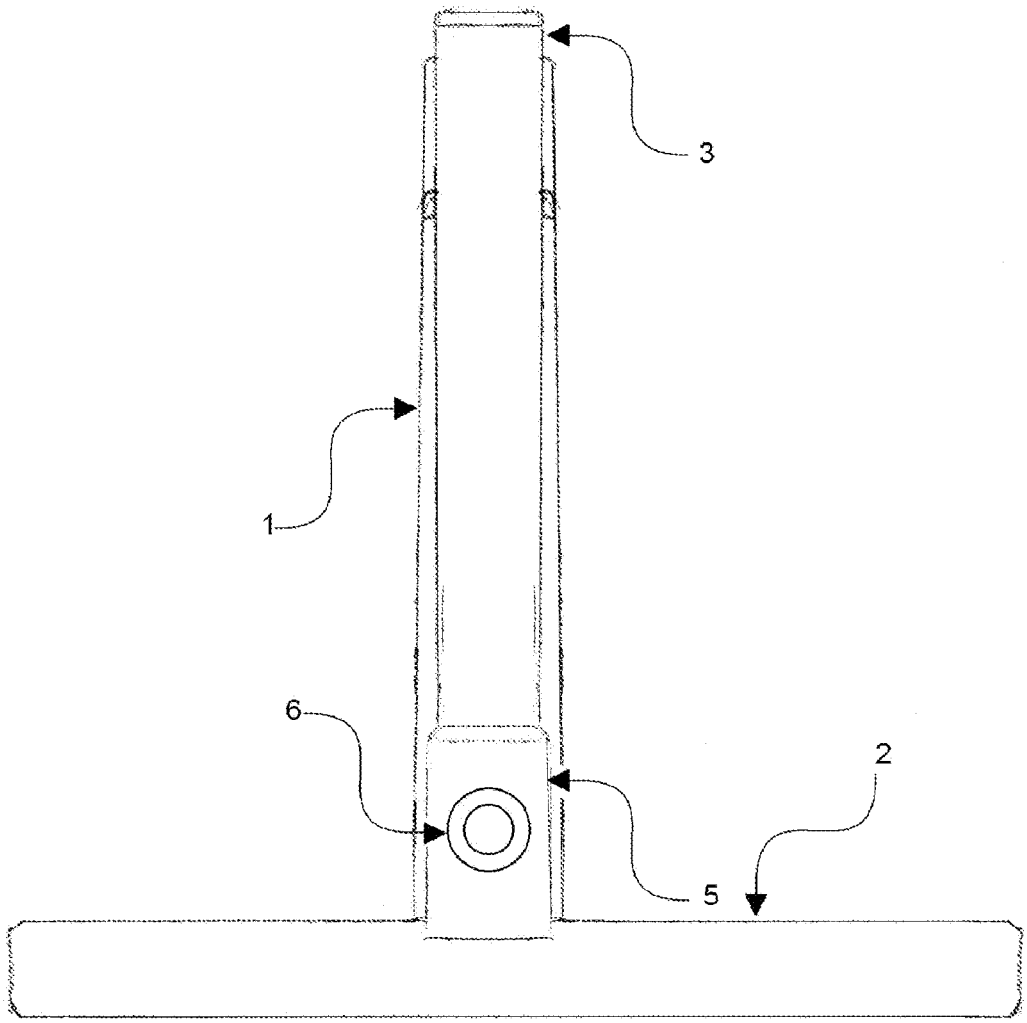
FIG. 3 is a right side elevation view of the "Wall Crasher" of FIG. 1.
Figure 4:
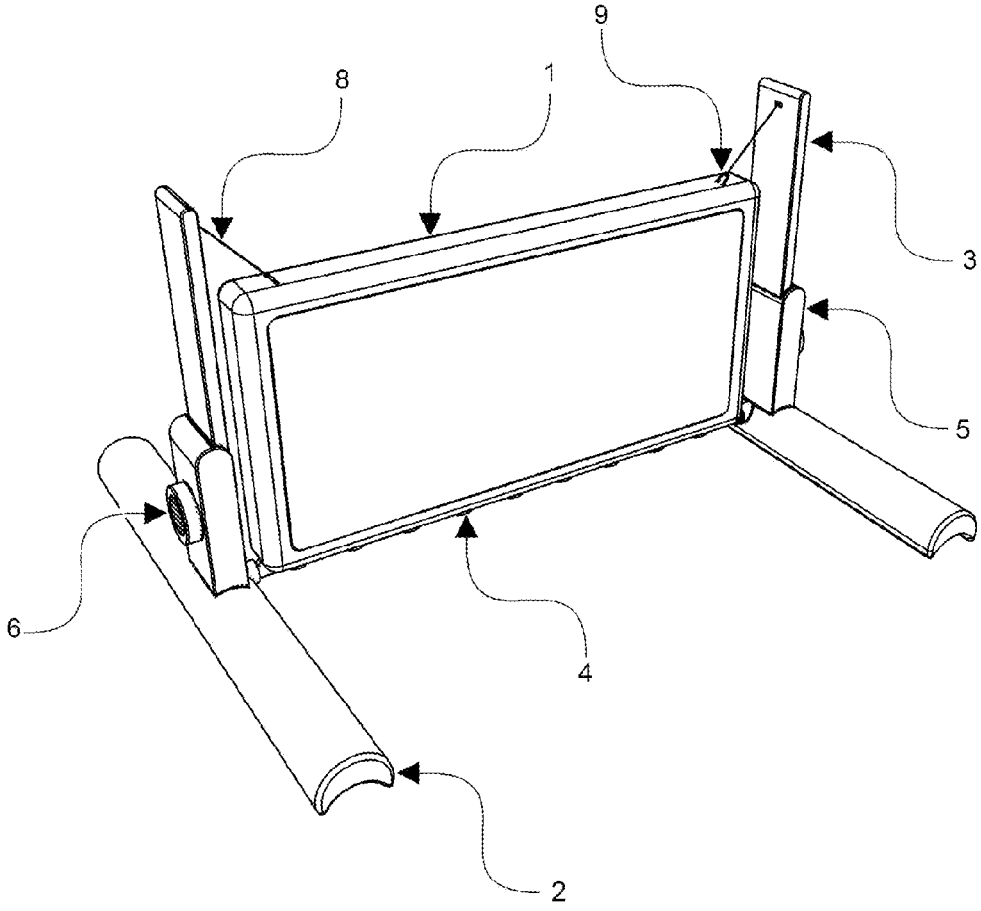
FIG. 4 is a top front perspective view the "Wall Crasher" of FIG. 1.
Figure 5:
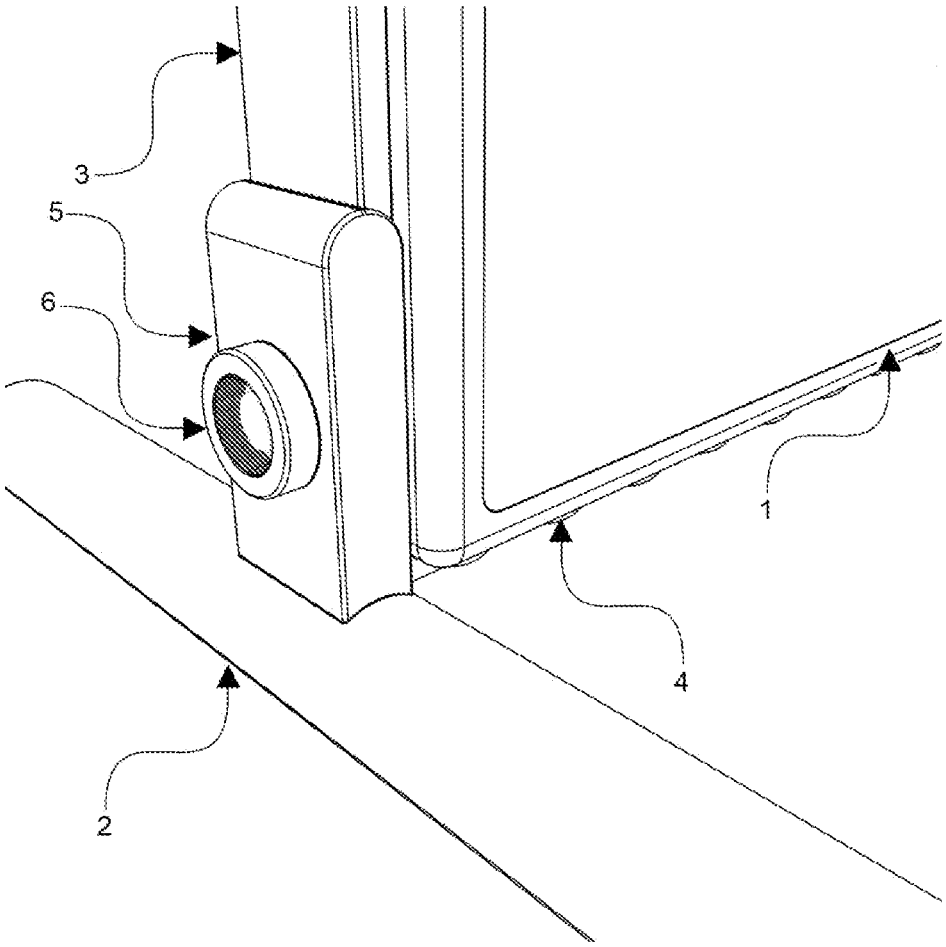
FIG. 5 is a front left perspective view of the "Wall Crasher" of FIG. 1.
Figure 6:
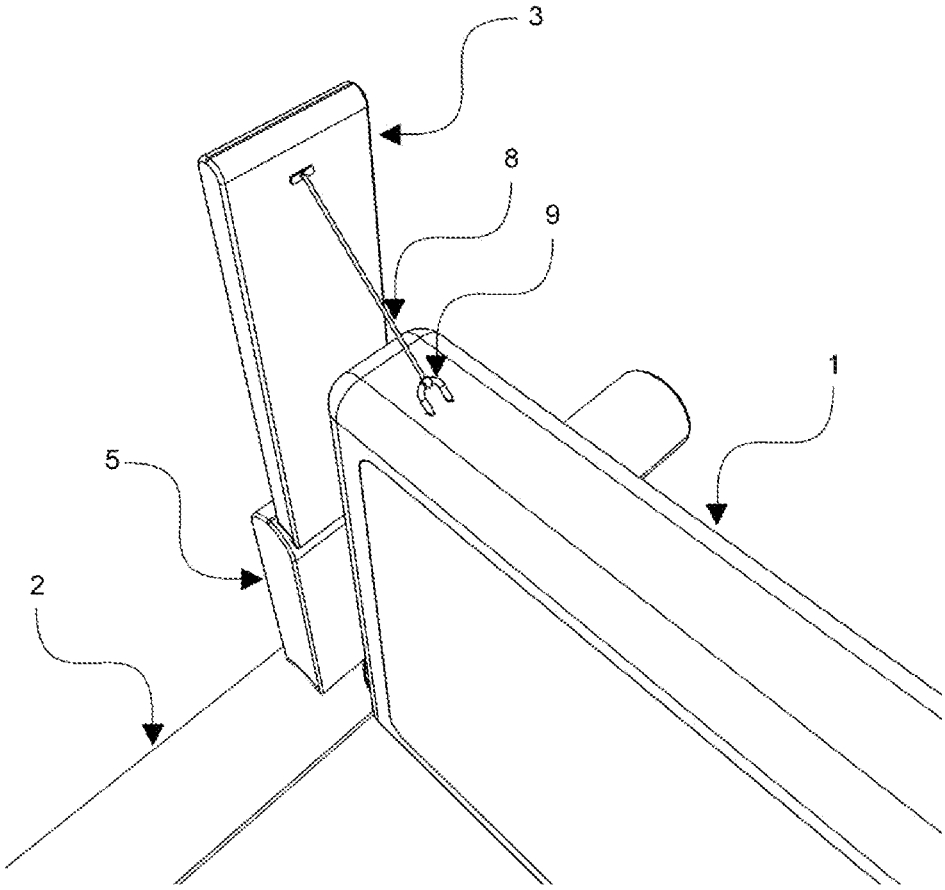
FIG. 6 is a top perspective view of the "Wall Crasher" of FIG. 1.
Figure 7:
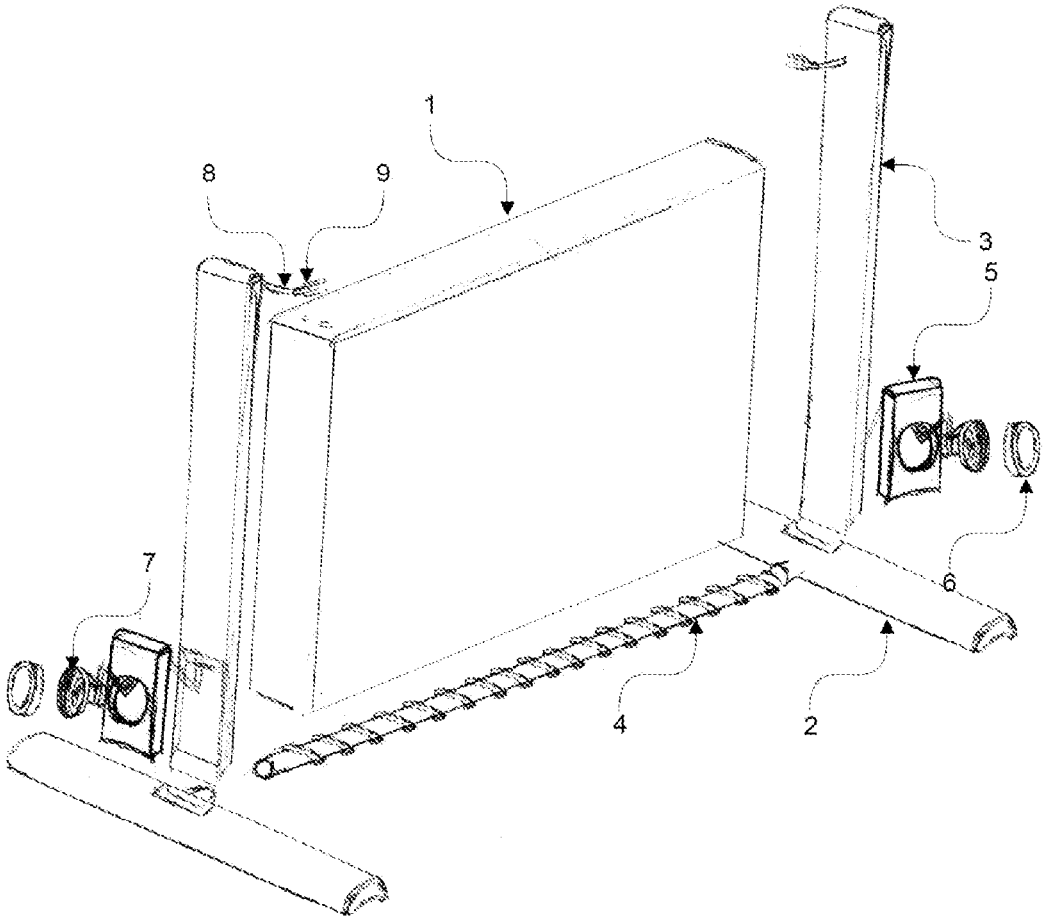
FIG. 7 is an exploded view of the "Wall Crasher" of FIG. 1.

The inventive device object of the present application is a vertically-standing mattress, which is designed to automatically reassume its vertical orientation when pushed down. Attached to either side of the mattress is a padded bar, preventing injury. The mattress is automatically wound into its initial orientation by a taut coil of elastic rope housed in a plastic container. As it can be inferred from the drawings essential components of the "Wall Crasher" of the present application include: An inflatable mattress, a securing bar, a taut coil of rope, a set of pins, a plastic circular spring housing, a set of Styrofoam-coated frames, and a set of rigid vertical frames.

In one preferred embodiment of the "Wall Crasher" of the present application the device features a wider inflammable mattress.

In a further separate preferred embodiment of the "Wall Crasher" the device's mattress feature contains a replaceable face, allowing it to be removed and interchanged with designs or patterns of the user's choosing.

In one of its preferred embodiments the inventive device of the present application embodies a vertically-standing mattress capable of reassuming its initial orientation comprising: An inflatable mattress (1), with a set of Styrofoam-coated metal frames (2) attached to a set of rigid vertical metal support frames (3) and a striated securing bar (4). Said rigid vertical metal support frames (3) are attached to a metal retainer (5) for rigidly holding a cylindrical plastic housing (6) containing a spring (7) secured to a taut coil of rope (8) with a pin (9) for securely attaching to said inflatable mattress (1). In a separate preferred embodiment of the vertically-standing mattress capable of reassuming its initial orientation of the present application the inflatable mattress (1) contains a replaceable and interchangeable face (10) interchangeable with a design or pattern of the same dimensions of the initial replaceable and interchangeable face (10).

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for the entertainment of children and adults comprising: an inflatable mattress, held by a set of coated metal frames and a striated securing bar; wherein said set of coated metal frames are attached to two metal support frames, rigidly held in place over a cylindrical housing by a metal retainer; wherein said metal retainer comprises a spring secured to a taut coil of rope, with a pin for securely attaching to said inflatable mattress.

2. The device for the entertainment of children and adults of claim 1 where said set of coated metal frames are Styrofoam-coated.

3. The device for the entertainment of children and adults of claim 1 where said set of coated metal frames are arranged in a generally rectangular square.

4. The device for the entertainment of children and adults of claim 3 where said generally rectangular square is held so that its wider sides are parallel to the ground.

5. The device for the entertainment of children and adults of claim 1 where said metal support frames form a U shaped frame where the bottom part of the U is generally parallel to the ground.

6. The device for the entertainment of children and adults of claim 1 where said cylindrical housing is made of plastic.

* * * * *